United States Patent [19]

Gertsch

[11] 3,984,124

[45] Oct. 5, 1976

[54] COMBINATION SAFETY SKI BINDING AND SKI SHOE

[75] Inventor: Ulrich Gertsch, Matten, Switzerland

[73] Assignee: Gertsch AG, Zug, Switzerland

[22] Filed: June 24, 1975

[21] Appl. No.: 589,863

[30] Foreign Application Priority Data

June 24, 1974 Switzerland ..... 8646/74

[52] U.S. Cl. ..... 280/618; 280/636; 36/117

[51] Int. Cl.² ..... A63C 9/08

[58] Field of Search ..... 280/11.35 K, 11.35 Y, 280/11.35 E, 11.35 D, 11.35 A, 11.35 C, 11.35 R, 618, 617, 611

[56] References Cited

UNITED STATES PATENTS

| | | | |
|---|---|---|---|
| 2,094,667 | 10/1937 | Parish | 280/11.35 K |
| 3,727,932 | 4/1973 | Druss et al. | 280/11.35 K |
| 3,752,491 | 8/1973 | Fend | 280/11.35 K |
| 3,753,571 | 8/1973 | Gertsch et al. | 280/11.35 K |
| 3,785,668 | 1/1974 | Marker | 280/11.35 R |
| 3,834,723 | 9/1974 | Erlebach | 280/11.35 M |

*Primary Examiner*—M. H. Wood, Jr.
*Assistant Examiner*—Milton L. Smith
*Attorney, Agent, or Firm*—Martin A. Farber

[57] ABSTRACT

A combination safety ski binding and ski shoe, with a release plate fastened on the ski at its both ends until the exceeding of a predetermined force action, the release plate being releasably connected with the shoe by a sole holder and a heel holder. The sole holder as well as the front anchorage of the release plate are rearwardly offset with respect to the tip of the shoe, wherein the sole holder has coupling mounts positively engaging in each other, and the shoe sole between the mount arranged thereon and the heel holder is formed considerably stiff.

4 Claims, 3 Drawing Figures

COMBINATION SAFETY SKI BINDING AND SKI SHOE

The present invention relates to a combination safety ski bonding and ski shoe, with a release plate fastened on the ski at its both ends until exceeding a predetermined force action, the release plate being releasably connected with the shoe by a sole support holder and a heel support holder.

With known plate bindings of this type, the heel holder and the sole holder, respectively, engage on the two ends of the shoe sole, that is on the heel and on the tip of the sole, whereby the largest adjustment range for different size ski shoes is required. Correspondingly, the release plates of the prior known plate bindings are relatively long. Consequently the front end of the release plate with its support holder and therefore the point of rotation which is decisive during the forward release are far away from the axis of the leg, which from a safety technical view, particularly for the quasi statical front falls, is unfavorable. Moreover such long plates are comparatively heavy, since they must be built correspondingly thick in order to attain the necessary stability.

It is an object of the invention to avoid these disadvantages by a combination safety ski binding and ski shoe in accordance with the invention in that the sole support holder as well as the front anchorage of the release plate are rearwardly offset with respect to the tip of the shoe and, whereby the sole holder has coupling mounts or abutments positively (i.e., without friction or slipping) engaging in each other and the shoe sole between the mount arranged thereon and the heel holder is formed considerably stiff.

With such an arrangement the release plate and thus the distance between the axis of the leg and the point of rotation (which is decisive during the front fall) is substantially shorter, whereby simultaneously the weight of the release plate can be substantially reduced without impairing the stability. A further advantage of the described inventive arrangement results in that the sole of the shoe or boot need only be formed stiff or rigid between the coupling mount arranged thereon and the heel holder. That means in other words, that with the formation of the front shoe part, consideration must only be made of the walking comfort. In this manner however, the combination in accordance with the invention is not at all limited to the use of specially formed ski shoes or boots. In order to be able to include in the combination conventional soles which are rigid in their entire length, a bulge-like or roll-like mount can be provided on the sole of the shoe approximately in the range of the ball of the foot. In this manner the disadvantages of modern ski shoes are avoided, which arise during walking from the rigidity and during standing from the fact that with such ski shoes the heel is very high with respect to the ball region and the leg therefore effects a forward leaning position. The bulge-type mount forms during walking a rolling center in the range of the ball region, whereby a natural pace of gait and a natural feeling of walking are brought about, this all the more, as this layer mount also equalizes the artificial (due to the construction of the shoe) difference in height between the heel and ball of the foot. In order to bring about the forward leaning position of the ski, in the area of the heel the binding can have a support which is raised substantially by or equal to the thickness of the bulge-type mount.

With the above and other objects in view the present invention will become more clearly understood from the following detailed description of three embodiments of the invention with reference to the drawings, in which.

Figure 1:
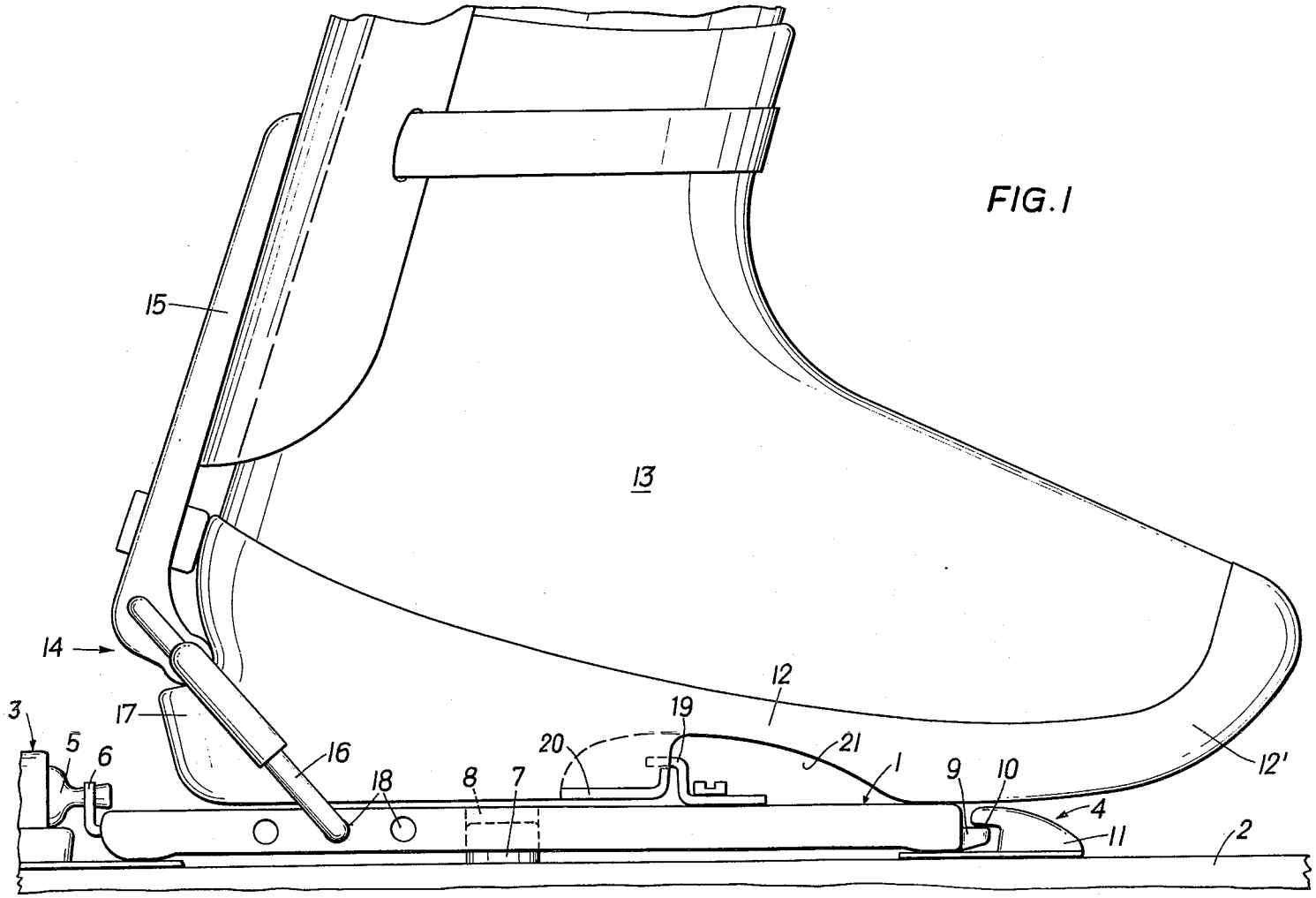
FIG. 1 is a side elevational view of a first embodiment of the combination safety ski binding and ski shoe of the invention.
Figure 2:
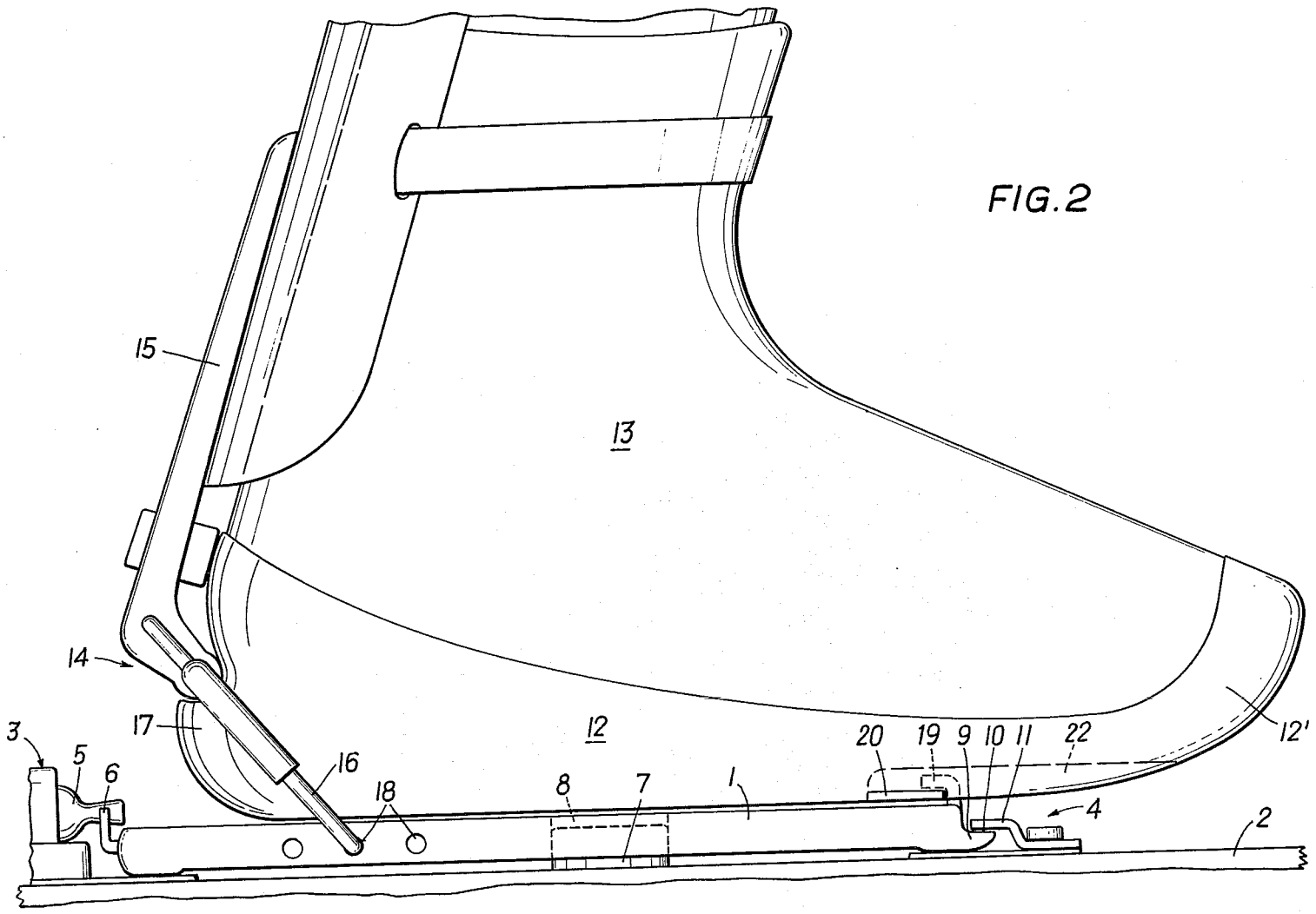
FIG. 2 is a side elevational view of a second embodiment of the invention.
Figure 3:
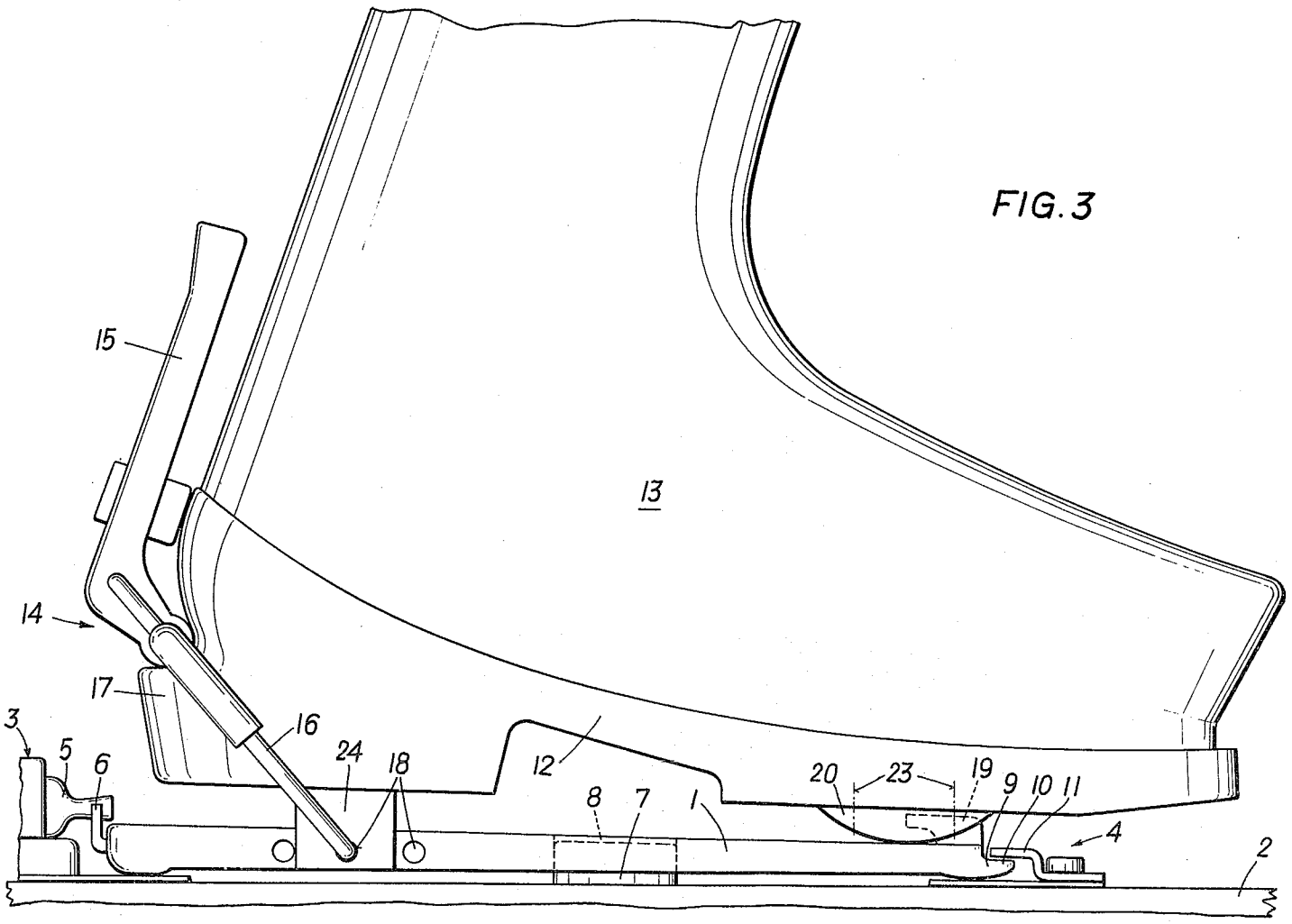
FIG. 3 is a side elevational view of a third embodiment of the invention.

Referring now to FIGS. 1 – 3 of the drawings, in all three embodments the binding possesses a release plate 1 which is held on the ski 2 by means of a rear anchorage or fastener 3 and a front anchorage or fastener 4 until the reaching of a predetermined force action. The rear anchorage 3 has a locking stud 5 which is universally pivotable in all directions against a spring force, which stud engages in an upper open recess (not shown in the drawing) of the thereto coordinated coupling piece 6 of the release plate 1, in order thereby to fix the rear end of the release plate 1 with a predetermined force from moving upwardly and toward both sides. Further, the release plate 1 is pivotally mounted on a stud 7, the latter being rigidly fixed to the ski. The stud 7 engages in a corresponding hole in the release plate 1 without preventing the lifting of the release plate. On the front end of the release plate 1, there is provided a projecting lug 9 which has a guide surface 10 substantially parallel to the surface of the ski, which lug 9 is shown in the drawings as being overlapped by a holding part 11 of the front anchorage, the holding part being secured to the ski. As evident from the drawing without more, the arrangement is set such that the holding part 11 fixes the front end of the release plate 1 only in the vertical directions, however not in transverse direction. The described formation of the rear anchorage 3 and the front anchorage 4, respectively, is basically known and correspondingly, also the manner of functioning of these anchorages. Both can have any other formation whatsoever. It is only important that the front anchorage is offset of displaced rearwardly relative to the front end of the shoe sole 12 of the ski shoe 13. From this there results a reduction of the length of the plate such that the front end of the plate is disposed substantially in the region of the ball of the foot.

The heel support holder 14 is of known construction in all three embodiments. It has a hoop shackle 16 equipped with a clamping lever 15, which shackle overlappingly engages the shoe heel 17 by means of the shorter arm of the clamping lever 15. The shackle 16 is fastened with inwardly angled-off ends on its two legs 16 in laterally open transverse holes 18 of the release plate 1. The latter, in all three embodiments, carries a rearwardly directed hook shaped coupling mount 19 secured thereto, which cooperates with a counter mount 20 arranged on the sole 12 of the shoe, overlappingly engaging the same. With the embodiment according to FIG. 1, the counter mount 20 is directly connected to the heel 17 substantially in the range of the axis of the leg in a recess 21 of the sole of the shoe. Correspondingly, the hook shaped mount 19 is disposed rearwardly offset or set back from the front end of the release plate 1. With the embodiments according to FIGS. 2 and 3, to the contrary the hook formed mount 19 is located directly on the front end of the release plate 1. In the embodiment of FIG. 2, moreover, the mount 20 is arranged in the rear end portion of a front opening channel recess 22 of the shoe sole. In the embodiment according to FIG. 3, a roll- or bulge-like counter mount 20 is provided, which (as indicated by the numeral 23) has been secured subsequently to the sole of the shoe of a conventional ski shoe in the region of the ball of the foot. For all three embodiments, the hook formed mount 19 and the counter mount 20 can cooperatively engage one another by moving the ski shoe from the rear toward the front, whereby the positive (i.e., without slipping) interengaging in each other of these mounts of the sole holder means 19 – 20 is maintained by the forward directed component of the force exerted by the heel support holder 14.

With the embodiment according to FIGS. 1 and 2 it suffices if the sole 12 of the shoe between the heel 17 and the counter mount 20 is rigid. The front part 12' of the sole of the shoe can (as illustrated) be rounded-off or inclined and moreover can be formed soft, i.e., flexible or nonrigid. In this manner, movement is quite considerably facilitated and the comfort of the foot (since the entire shoe front can be correspondingly formed) increased and simultaneously the weight of the shoe is reduced, this without impairing the transmission of the forces from the ski to the foot or the other way around.

With the embodiment according to FIG. 3, the ball-like counter mount forms during movement or walking a roll-off center and bestows a natural foot position to the skier (likewise during standing still). For equalization or balancing of the bulge-like counter mount 20, a support piece 24 is provided, which support piece is held on the release plate 1 by means of the shackle 16 and offers the heel 17 a correspondingly raised support.

In all three embodiments the illustrated coarse adjustment means of the heel support holder (comprising the plurality of holes 18 in which the bent ends of the two arms of the shackle 16 may be adjustably disposed) if not necessary, since it is possible to attach the counter mounts 20 in standardized distance from the working point of application of the heel holder 14.

To summarize it can be said that the described arrangement provides important advantages with respect to safety as well as with respect to comfort and thereby the way is opened and disclosed to produce ski shoes which not only meet all requirements during skiing, but also are satisfactoryily wearable if one desires to move about without skis. This even in connection with the conventional ski shoes, which per se do not serve to make possible the mentioned advantages.

While I have set forth several embodiments of the present invention, it is to be understood that these embodiments are given by example only and not in a limiting sense.

I claim:

1. A combination safety ski binding and ski shoe, the latter having a sole and a tip, comprising a release plate means for being fastened at both ends thereof on a ski until the exceeding of a predetermined force effect and at least partly including anchorage means therefor, a sole holder means and a heel holder means for operatively releaseably connecting said release plate means with said shoe, said sole holder means and said anchorage means of said release plate means being rearwardly offset with respect to said tip of said shoe, said sole holder means including coupling mounts positively engaging in each other, said sole of said shoe being formed substantially rigid between one of said mounts arranged thereon and said heel holder means, said sole of said shoe being formed with a recess, said sole having a portion extending between said one mount and said tip of said shoe, said sole of said shoe is flexible in said portion, said coupling mounts including a rearwardly directed hook shaped coupling mount on the release plate means and a counter mount constituting said one mount arranged on the sole of the shoe, said hook shaped coupling mount cooperatingly overlappingly engaging said counter mount, said counter mount being arranged in said recess of the sole of the shoe and said hook shaped coupling mount is rearwardly set back from said tip of said shoe.

2. The combination set forth in claim 1, wherein said shoe includes a heel and a leg portion adapted to receive a leg, said hook shaped coupling mount is directly connected to said heel of said ski shoe disposed substantially in a range of the axis of a leg in said leg portion of said shoe, and is rearwardly set back from a front end of said release plate means.

3. A combination safety ski binding and ski shoe, the latter having a sole and a tip, comprising a release plate means for being fastened at both ends thereof on a ski until the exceeding of a predetermined force effect and at least partly including anchorage means therefor, a sole holder means and a heel holder means for releaseably connecting said release plate means with said shoe, said sole holder means and said anchorage means of said release plate means being rearwardly offset with respect to said tip of said shoe, said sole holder means including coupling mounts positively engaging in each other, said one mount on said sole of said shoe constitutes a bulge-like mount substantially in a region of a ball of a foot.

4. The combination set forth in claim 3, wherein said binding includes a support means elevated substantially by the thickness of said bulge-like mount and disposed in a heel range of said shoe.

* * * * *